US008684482B2

(12) United States Patent
Kanaya et al.

(10) Patent No.: US 8,684,482 B2
(45) Date of Patent: Apr. 1, 2014

(54) TEXTILE PRINTING APPARATUS AND TEXTILE PRINTING METHOD

(75) Inventors: Nobuhiro Kanaya, Matsumoto (JP); Takuya Fujita, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/612,555

(22) Filed: Sep. 12, 2012

(65) Prior Publication Data

US 2013/0076812 A1 Mar. 28, 2013

(30) Foreign Application Priority Data

Sep. 26, 2011 (JP) ..... 2011-209193

(51) Int. Cl.
*B41J 2/195* (2006.01)

(52) U.S. Cl.
USPC ..... 347/7; 347/16; 347/104

(58) Field of Classification Search
USPC ..... 347/6, 7, 14, 16, 19, 43, 101, 104–106
See application file for complete search history.

(56) References Cited

U.S. PATENT DOCUMENTS

| | | | | |
|---|---|---|---|---|
| 6,302,519 | B1 * | 10/2001 | Fukuda et al. | 347/43 |
| 2005/0093905 | A1 | 5/2005 | Ikeda | |
| 2009/0102869 | A1 | 4/2009 | Niimi et al. | |

FOREIGN PATENT DOCUMENTS

| | | |
|---|---|---|
| JP | 2005-103791 | 4/2005 |
| JP | 2009-101592 | 5/2009 |

* cited by examiner

*Primary Examiner* — Juanita D Jackson
(74) *Attorney, Agent, or Firm* — Workman Nydegger

(57) ABSTRACT

A textile printing apparatus includes a liquid remaining amount grasping unit which grasps remaining amounts of respective two or more kinds of liquids, and a control unit which performs control of execution of printings onto a plurality of printed textile materials, the control unit has a control mode for, in advance of starting the execution of printings, specifying any print-executable printing specification from among the printing specifications on the basis of the remaining amounts of the respective liquids and the contents of the respective printing specifications, and then, starting execution of any printing based on the any print-executable printing specification having been specified.

6 Claims, 11 Drawing Sheets

FIG. 8

| | FIRST PRINTED TEXTILE MATERIAL | SECOND PRINTED TEXTILE MATERIAL | EFFECT |
|---|---|---|---|
| (A) | SECOND PRINTING SPECIFICATION USING WHITE INK | FIRST PRINTING SPECIFICATION NOT USING WHITE INK | EFFECTIVE |
| (B) | FIRST PRINTING SPECIFICATION NOT USING WHITE INK | SECOND PRINTING SPECIFICATION USING WHITE INK | EFFECTIVE |
| (C) | SECOND PRINTING SPECIFICATION USING WHITE INK | SECOND PRINTING SPECIFICATION USING WHITE INK | INEFFECTIVE |
| (D) | FIRST PRINTING SPECIFICATION NOT USING WHITE INK | FIRST PRINTING SPECIFICATION NOT USING WHITE INK | EFFECTIVE |

TEXTILE PRINTING APPARATUS AND TEXTILE PRINTING METHOD

BACKGROUND

1. Technical Field

The present invention relates to a textile printing apparatus and a textile printing method for performing a printing onto a fabric, i.e., a printed textile material, by means of an ink jet method or the like.

2. Related Art

There have been known some ink jet textile printing apparatuses which perform a printing of a desired image onto the surface of a fabric, such as a T-shirt, by causing a textile print head thereof to eject a plurality of color inks onto the surface of the fabric (for example, refer to JP-A-2005-103791).

In order to prevent the occurrence of printing failures due to the lack of ink, these ink jet textile printing apparatus are each provided with ink remaining amount detection sensors for detecting the remaining amounts of corresponding color inks. Further, such an ink jet textile printing apparatus is configured to, when any one of the ink remaining amount detection sensors has detected the insufficiency of the remaining amount of the corresponding color ink, suspend all printings to be performed afterwards without any consideration of the colors of inks to be used in the printings.

Moreover, the ink jet textile printing apparatus is configured to, upon detection of the insufficiency of the remaining amount of the ink, prompt users to replace an ink cartridge corresponding to the ink whose remaining amount is insufficient by indicating an error message for notifying the insufficiency of the remaining amount of the ink.

Meanwhile, there have been also provided some large-scaled ink jet textile printing apparatuses which are configured to, in order to prevent the occurrence of printing suspension situations due to errors such as the lack of ink, be provided with two sets of set trays arranged in the width direction of the apparatus body thereof, and further be independently provided two sets of printing execution units. Further, these two sets of printing execution units include textile print heads and carriages therefor which individually perform printings onto two sheets of printed textile materials set on the two sets of set trays on the basis of printing specifications corresponding to the two sheets of printed textile materials, respectively (for example, refer to JP-A-2009-101592).

However, the above-described textile printing apparatuses disclosed in JP-A-2005-103791 and JP-A-2009-101592 have been configured such that, even when the insufficiency of the remaining amount of ink has occurred with respect to just some of the inks, all printings are suspended, and any printing to be executed by the printing execution unit is not resumed until at least the completion of replacements of ink cartridges corresponding to the inks whose remaining amounts are insufficient.

For example, in the ink jet textile printing apparatus disclosed in JP-A-2009-101592, under the state where, regarding one set tray, a printing specification is set, and it specifies that a T-shirt having a white background is set thereon, and an image printing using color inks is directly executed thereonto; while, regarding the other set tray, another printing specification is set, and it specifies that a T-shirt having a color background is set thereon, a background printing using a white color is executed thereonto, and subsequently, an image printing using color inks is executed onto the resultant background, when the insufficiency of the remaining amount of the white color has been found at the start of executing the printings, as a result, all printings including the printing regarding the one set tray, which does not use the white color, are suspended.

Therefore, there has been a disadvantage in that the operational efficiency of textile printings is reduced to a degree equivalent to that resulting from not executing a printing regarding the T-shirt having a white background, which is set on the one set tray, and onto which the printing can be executed even if the remaining amount of the white color ink is insufficient.

SUMMARY

An advantage of some aspects of the invention is to provide a textile printing apparatus and a textile printing method which enable improvement of the operational efficiency of textile printings in the case where a plurality of printed textile materials are set on a set tray such that the printed textile materials substantially align in a direction along the movement of the set tray, printings based on two or more printing specifications including at least a first printing specification using a first liquid and a second printing specification using a second liquid are executed onto the plurality of printed textile materials.

A textile printing apparatus according to a first aspect of the invention includes a liquid ejection head which ejects two or more kinds of liquids including at least a first liquid and a second liquid; a set tray which moves relative to the liquid ejection head, and which enables setting of a plurality of printed textile materials thereon such that the printed textile materials substantially align in a direction along the movement of the set tray; a liquid remaining amount grasping unit which grasps remaining amounts of the respective two or more kinds of liquids; and a control unit which performs control of execution of printings onto the plurality of printed textile materials, and in the case where the control unit is given an instruction for executing printings onto a plurality of printed textile materials, which are set on the set tray so as to substantially align in the direction along the movement of the set tray, on the basis of two or more kinds of printing specifications including at least a first printing specification using the first liquid and a second printing specification using the second liquid, the control unit has a control mode for, in advance of starting the execution of printings, specifying any print-executable printing specification from among the printing specifications on the basis of the remaining amounts of the respective liquids and the contents of the respective printing specifications, and then, starting execution of any printing based on the any print-executable printing specification having been specified.

Here, the "printed textile material" means a "textile" targeted for a printing, and includes a woven fabric, a knitted fabric, a nonwoven cloth and the like, each of which is made of a natural fiber such as cotton, silk or sheep wool, a chemical fiber such as nylon, or a composite fiber obtained by mixing any ones of the natural fibers and the chemical fibers. Further, the printed textile material includes both a long sheet type textile material which is wound into a rolled state, and a textile material which is cut by a predetermined length. Moreover, the printed textile material includes not only a sewn cloth such as a T-shirt, and a sewn fabric related to furniture or the like, such as a handkerchief, a scarf, a towel, a curtain, a sheet or a bed cover, but also a textile or the like which is in a stage before or after a cutting process, and which exists as a part in a stage before a sewing process.

Further, a "printing specification" used in this description means a combination of a kind of a printed textile material (defined by a background color and the like), and a kind of a liquid used for a textile printing (defined by the color of an ink, and the like). For example, this "printing specification" includes a specification such as a specification for forming images by performing a printing of color inks directly onto the surface of a printed textile material (for example, a T-shirt) having a white background; a specification for forming images by performing a printing of a background ink onto the surface of a printed textile material having a color background, and performing a printing of color inks onto the background layer having been formed; or a specification for forming an overcoating layer by further performing a printing of a predetermined processing liquid onto the surface of the images having been formed in either of the ways described above.

According to this aspect, in the case where a plurality of printed textile materials are set on a set tray such that the printed textile materials substantially align in a direction along the movement of the set tray, and printings are performed onto the plurality of printed textile materials on the basis of two or more printing specifications including at least a first printing specification using a first liquid and a second printing specification using a second liquid, even if, because of the insufficient remaining amounts of some of the inks, any printing based on any print non-executable printing specification corresponding to at least one of the some of the inks cannot be executed, any printing based on any other print-executable printing specification can be executed, and thus, it is possible to improve the operational efficiency of the existing textile printing.

Further, according to this aspect, a set tray capable of setting a plurality of printed textile materials thereon such that the printed textile materials substantially align in a direction along the movement of the set tray is provided, and thus, it is possible to execute textile printings onto a plurality of printed textile materials corresponding to respective different printing specifications by providing such a simple configuration that merely causes a transportation unit to move the set tray.

A textile printing apparatus according to a second aspect of the invention is configured such that, in the first aspect, the first liquid corresponds to a color textile-printing ink which enables formation of a color image, the second liquid corresponds to a white ink, and if a grasping result obtained by the liquid remaining amount grasping unit indicates a state where the remaining amount of the white color is insufficient, and further, the remaining amount of the color textile-printing ink is sufficient, the control unit is configured not to execute any printing based on any printing specification using the white ink, but to execute only any printing based on any printing specification using only the color textile-printing ink.

According to this aspect, even if the remaining amount of the while ink is insufficient, any printing based on any printing specification using only the color textile-printing ink is executed, and thus, it is possible to improve the operational efficiency of the existing textile printing.

A textile printing apparatus according to a third aspect of the invention is configured such that, in the second aspect, if a grasping result obtained by the liquid remaining amount grasping unit indicates a state where the remaining amount of the white color is sufficient, and further, the remaining amount of the color textile-printing ink is insufficient, the control unit does not perform any printing based on any printing specification.

According to this aspect, it is a feature that, if determined from only the remaining amount of the white ink, any printing based on any printing specification using the white ink can be executed; however, the printing is not executed purposely. In the case where a background is formed by using a white ink, the background can be formed by ejecting only the white ink; however, in most of cases, the small amount of a color ink is ejected to be mixed with the white ink. This processing is based on a thought that, even in the case of a white-color background layer, it is generally performed to form the white color as a bluish white color, a yellowish white color, a reddish white color or the like.

A textile printing apparatus according to a fourth aspect of the invention is configured such that, in the first aspect, in the case where the control unit is given an instruction for executing printings based on three kinds of printing specifications resulting from adding a third printing specification in which an overcoating liquid is further used as a third liquid, the control unit is configured to determine whether it is possible or not to execute any printing which uses the overcoating liquid on the basis of the remaining amount of the overcoating liquid, which has been grasped by the liquid remaining amount grasping unit.

According to this aspect, in the case where, for the purpose of protecting print images formed on the surface of a printed textile material, an overcoating layer is formed on the surface of the printed textile material, regarding any printing which uses the overcoating liquid, it is controlled whether it is to be allowed to execute the any printing, or not, depending on the remaining amount of the overcoating liquid, and thus, it is possible to improve the operational efficiency of the existing textile printing just like in the case of the first aspect.

A textile printing apparatus according to a fifth aspect of the invention is configured such that, in the first aspect, in the case where, in a certain printing specification corresponding to a print job to be executed, the remaining amount of a liquid used in the certain printing specification is insufficient, if there is prepared a next print job based on a printing specification which targets a printed textile material whose kind is the same as that of a printed textile material targeted by the certain printing specification, and which uses a liquid whose remaining amount is not insufficient, the control unit executes the next print job prior to the print job based on the certain printing specification.

According to this aspect, the presence or absence of any print-executable printing specification is determined on the basis of not only a printing specification corresponding to a relevant print job but also a printing specification corresponding to a print job following the relevant print job. Therefore, it is possible to find out print-executable printing specifications to a larger extent, and thus, this leads to a further improvement of the operational efficiency of the existing textile printing.

A textile printing method according to a sixth aspect of the invention includes printing specification setting processing for, regarding a plurality of printed textile materials which are set on a set tray moving relative to a liquid ejection head capable of ejecting two or more kinds of liquids including at least a first liquid and a second liquid, and which substantially align in a direction along the movement of the set tray, setting two or more kinds of printing specifications including at least a first printing specification using the first liquid and a second printing specification using the second liquid; liquid remaining amount grasping processing for grasping the remaining amounts of the respective two or more kinds of liquids; and printing execution processing for, in advance of starting execution of printings based on the respective printing specifications, specifying any print-executable printing specification from among the printing specifications on the basis of the remaining amounts of the respective liquids and the contents of the respective printing specifications, and then, starting execution of any printing based on the any print-executable printing specification having been specified.

According to this aspect, just like in the case of the first aspect, any printing based on any printing specification not using any liquid for which the insufficiency of the remaining amount has been grasped can be executed, and thus, this leads to an improvement of the operational efficiency of the existing textile printing.

BRIEF DESCRIPTION OF THE DRAWINGS

The invention will be described with reference to the accompanying drawings, wherein like numbers reference like elements.

FIG. 8 is a tabular diagram illustrating the effectiveness of printing operations of an ink jet textile printing apparatus according to a first practical example of the invention.

DESCRIPTION OF EXEMPLARY EMBODIMENTS

Figure 1:
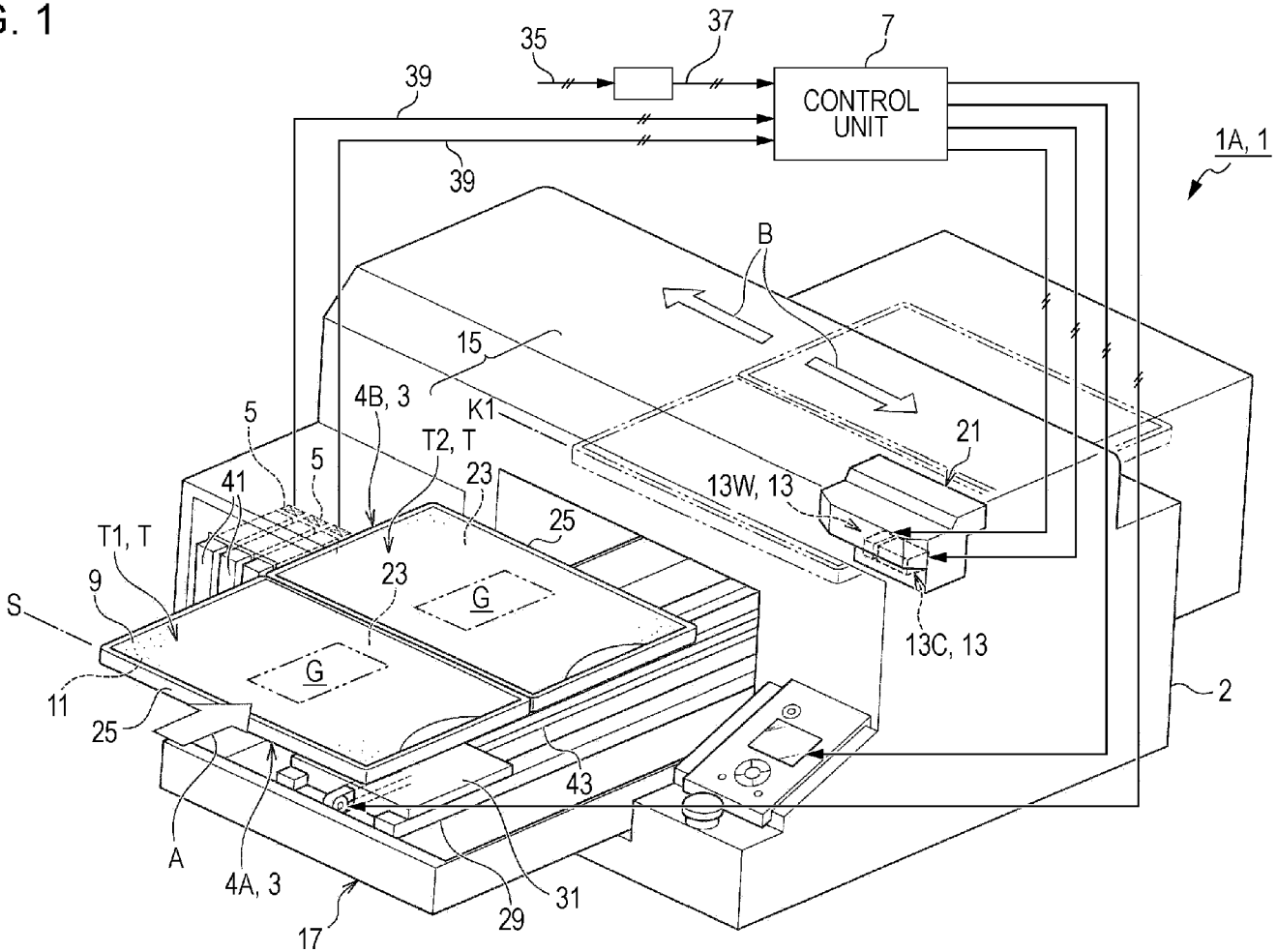
FIG. 1 is a perspective view illustrating the outline of a configuration of an ink jet textile printing apparatus according to a first practical example of the invention.

Hereinafter, a configuration of an ink jet textile printing apparatus 1, which is an example of a textile printing apparatus according to the invention, and a textile printing method, which is an example of a textile printing method performed by using the ink jet textile printing apparatus 1, will be described on the basis of a first practical example shown in FIGS. 1 to 8 and a second practical example shown in FIGS. 9 and 10.

In addition, in the following description, a T-shirt T having cylindrically sewn body and sleeve portions will be taken as an example of a printed textile material (hereinafter, also referred to as a "fabric"), and a front face of the T-shirt on which a printing image G is formed will be referred to as a first face 9, and a back face opposite the first face 9 will be referred to as a second face 11.

First Practical Example (Refer to FIGS. 1 to 8)

An ink jet textile printing apparatus 1A according to a first practical example of the invention includes a liquid ejection head 13 which is capable of ejecting two or more kinds of liquids 51 including at least a first liquid (corresponding to color inks) and a second liquid (corresponding to a white ink); a set tray 3 which moves relative to the liquid ejection head 13, and which is capable of setting a plurality of printed textile materials T1 and T2 thereon such that they substantially align in a direction along the movement of the set tray 3; liquid remaining amount grasping units 5 which independently grasps the remaining amounts of the respective two or more kinds of liquids (corresponding to the color inks and the white ink); and a control unit 7 which performs control of execution of printings onto the plurality of printed textile materials T1 and T2.

Further, in the case where the control unit 7 is given an instruction for executing printings onto the plurality of printed textile materials T1 and T2, which are set on the set tray 3 so as to substantially align in the direction along the movement of the set tray 3, on the basis of a first printing specification using the first liquid (corresponding to the color inks) and a second printing specification using the second liquid (corresponding to the white ink), the control unit 7 has a control mode for, in advance of starting execution of the printings, specifying any print-executable printing specification from the printing specifications on the basis of the remaining amounts of the respective liquids (corresponding to the color inks and the white ink), which have been grasped by the liquid remaining amount grasping units 5, and the contents of the respective printing specifications, and then, starting execution of any printing based on the any specified printing specification.

Here, the plurality of different kinds of liquids 51 correspond to color inks 51C, 51M, 51Y and 51K which are mainly used for forming images, and a white color 51W which is mainly used for forming a background. Further, the colors of the color inks 51C, 51M, 51Y and 51K include process colors composed of C (cyan), M (Magenta), Y (yellow) and K (black), and spot colors provided by various ink manufactures. In addition, other examples of an ink used for forming a background include a background ink containing a silver material, a gold material, a copper material or the like.

That is, in this practical example, the first liquid corresponds to color textile-printing inks (i.e., the color inks 51C, 51M, 51Y and 51K) capable of forming color images, and the second liquid corresponds to the white ink 5W, and in the case where the result of grasping obtained by the liquid remaining amount grasping units 5 indicates a state where the white ink has an insufficient remaining, and further, the color textile-printing inks (i.e., the color inks 51C, 51M, 51Y and 51K) each have a sufficient remaining amount, the control unit 7 is configured not to perform any printing based on any printing specification using the white color 5W, but to perform only any printing based on any printing specification using only at least one of the color printing inks (i.e., the color inks 51C, 51M, 51Y and 51K).

Further, in the ink jet textile printing apparatus 1A according to this first practical example, the set tray 3 is constituted of two individual set trays 4A and 4B which are capable of individually setting a first printed textile material T1 and a second printed textile material T2 thereon, respectively, and which are arranged in a transportation direction A along which the printed textile materials T1 and T2 are transported. In addition, naturally, the set tray 3 may be constituted as a single set tray.

Further, each of the individual set trays 4A and 4B is, for example, a rectangular flat-plate-shaped member, and at the center of the upper face thereof, a setting face 23 for supporting the printed textile material T by directly contacting with the second face 11 of the printed textile material T is formed across a wide range. Further, a frame 25 is framed at the surrounding portion of each of the set trays 4A and 4B. Under the state being framed in such a way as described above, the frames 25 are capable of setting the printed textile materials T1 and T2 without causing any wrinkle on the first faces 9 on which printed portions of the printed textile materials T1 and T2 are formed, respectively. Further, the frames 25 yield holding forces which suppress the misalignments of positions of the printed textile materials T1 and T2 being printed or being transported, respectively.

Further, regarding the liquids 51, the color inks 51C, 51M, 51Y and 51K, which are constituted by process colors composed of C (cyan), M (magenta), Y (yellow) and K (black), are employed as the first liquid, and the white ink 51W, which is used as a background ink, is employed as an example of the second liquid.

Moreover, regarding the liquid ejection head 13, two kinds of liquid ejection heads including a first liquid ejection head 13C and a second liquid ejection head 13W, which correspond to the respective two kinds of liquids 51, are provided. Further, of these, the first liquid ejection head 13C is configured to eject the color inks 51C, 51M, 51Y and 51K therefrom; while the second liquid ejection head is configured to eject the white ink 51W therefrom which is, as described above, used as a background ink.

Figure 4:
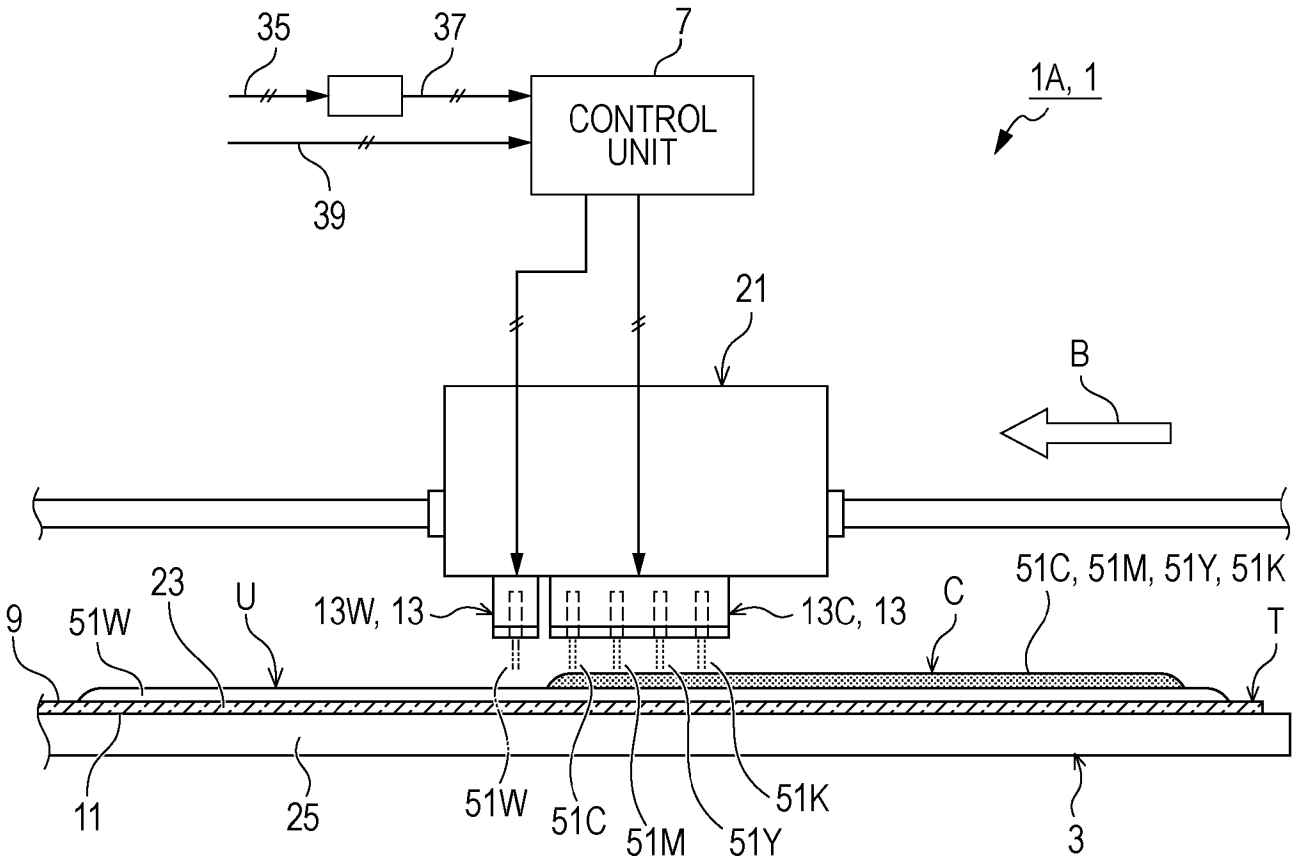
FIG. 4 is a front view illustrating an attachment configuration of a liquid ejection head of an ink jet textile printing apparatus according to a first practical example of the invention.

Further, the two kinds of liquid ejection heads 13C and 13W are attached to a carriage 21 so as to substantially align in a scanning direction B, shown in FIG. 4, along which the carriage 21 reciprocates, the scanning direction B being the width direction of the apparatus body 2, which intersects with the transportation direction A along which the printed textile material T is transported.

In addition, the two kinds of liquid ejection heads 13C and 13W may not be attached to the single carriage 21, but may be attached to respective different carriages.

The two kinds of liquid ejection heads 13C and 13W are supplied with the color inks 51C, 51M, 51Y and 51K, and the white color ink 51W, respectively, via tubes or the like leading from ink cartridges 41 which are located, for example, at the left side of the apparatus body 2 when viewed towards the front of the apparatus body 2.

Figure 2:
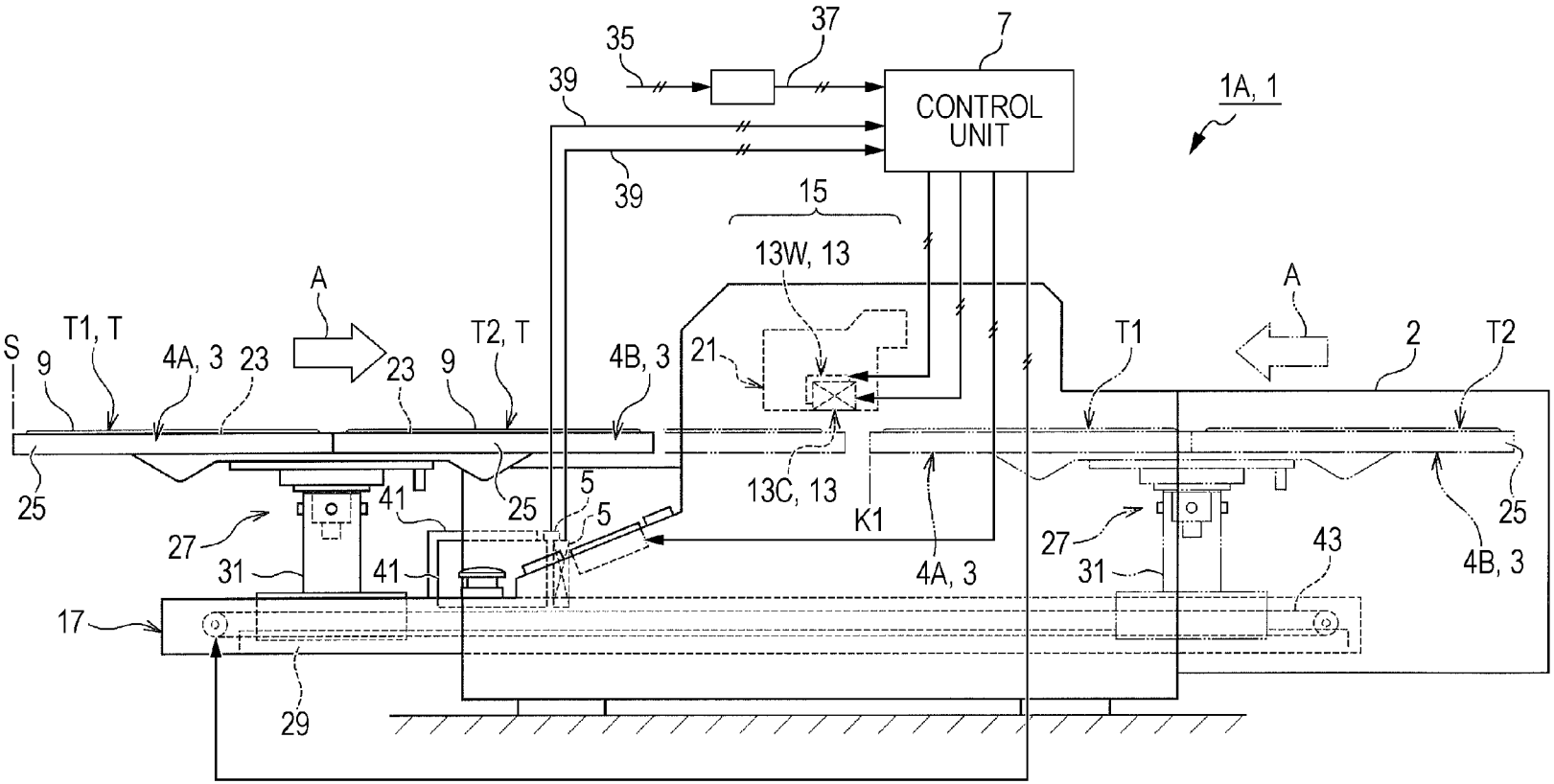
FIG. 2 is a side sectional view illustrating the outline of a configuration of an ink jet textile printing apparatus according to a first practical example of the invention.
Figure 3:
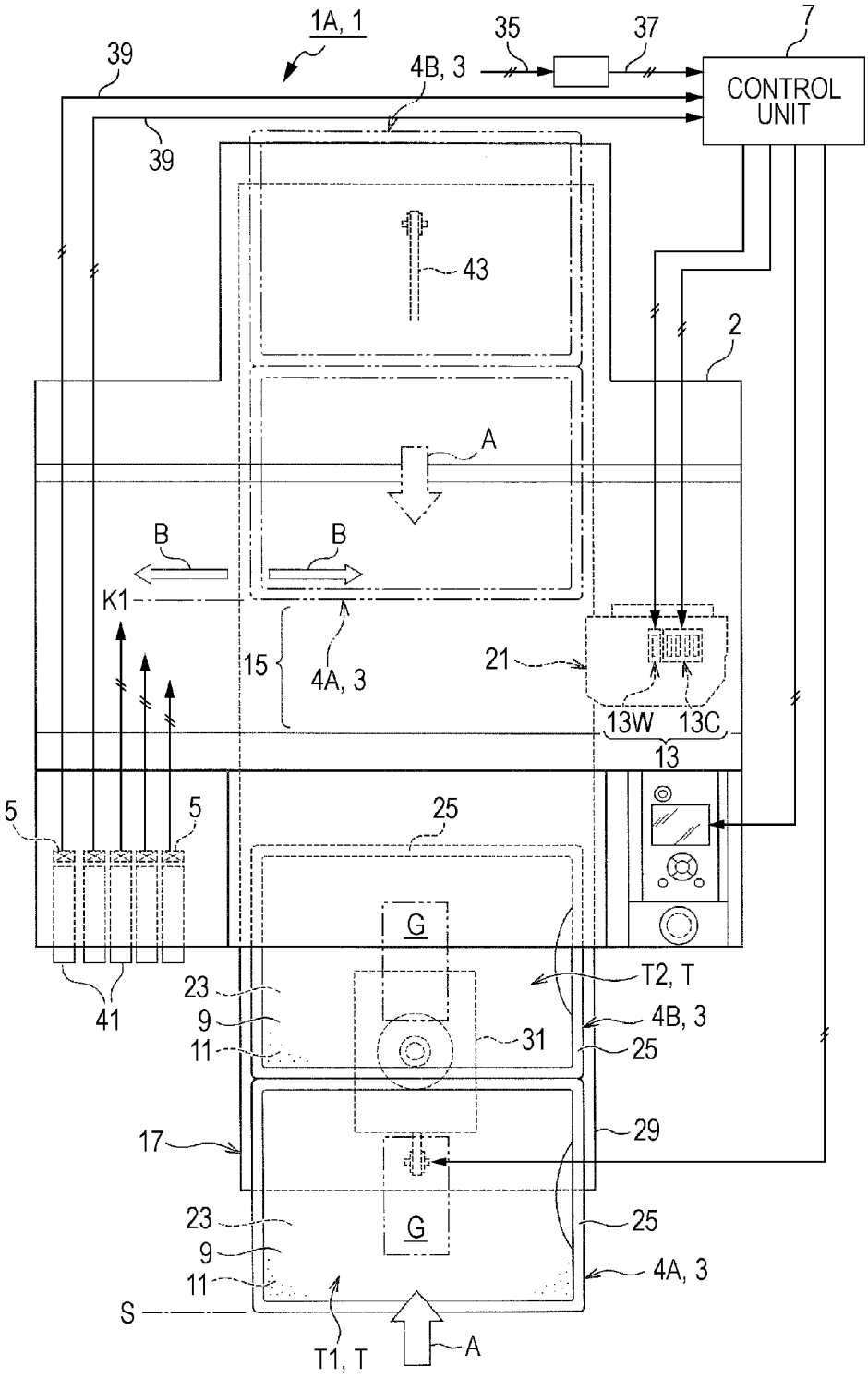
FIG. 3 is a plan view illustrating the outline of a configuration of an ink jet textile printing apparatus according to a first practical example of the invention.

Further, the individual two set trays 4A and 4B are constituted of a first set tray 4A for which a printing is performed first, and a second set tray 4B for which a printing is performed subsequently, and are attached so as to be in the state of being attachable and detachable to/from the transportation unit 17 via a suitable attachment mechanism 27, such as shown in FIG. 2.

The transportation unit 17 is constituted by providing a support base 29 spreading from the near side to the depth side of the apparatus body 2 along the transportation direction A; a support plate 31, which is an example of a mechanism located at the upper portion of the support base 29, and which includes a slider being attached so as to be reciprocatable along the transportation direction A and a columnar support having a predetermined height, which are located at the center in the transverse direction of the support base 29; and a driving mechanism employing a timing belt 43, which is an example of a mechanism for driving the support plate 31.

Further, the two individual set trays 4A and 4B are configured such that they can be reciprocated by the transportation unit 17 between a set position S which is located at the near side of an area where the printed textile materials T1 and T2 are set, and a printing start position K1 which is located at the depth side so as to interpose a printing execution area 15 between the set position S and itself.

Figure 5A:
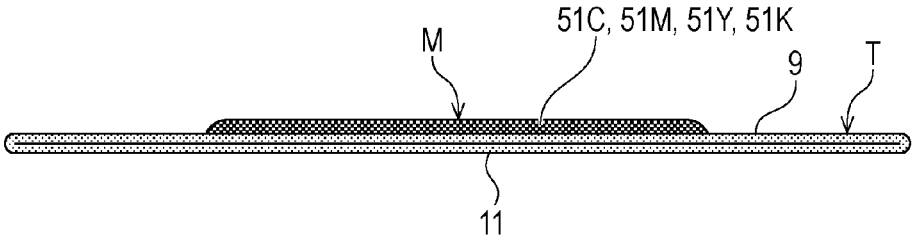
FIGS. 5A and 5B are vertical sectional front views illustrating respective mutually different printing specifications applicable to an ink jet textile printing apparatus according to a first practical example of the invention.
Figure 5B:
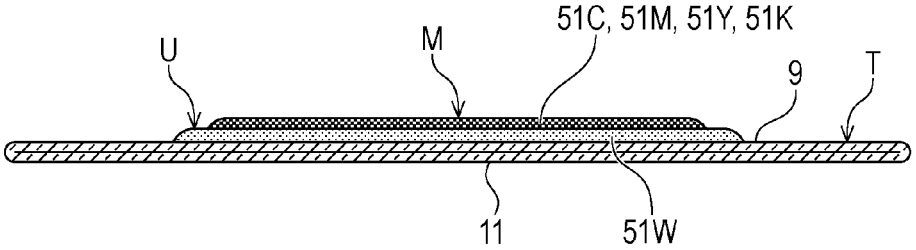

Further, in this practical example, two kinds of printing specifications shown in FIGS. 5A and 5B can be applied, and of these, the printing specification shown in FIG. 5A is a specification which is mostly employed in the case where the printed textile material T has a white background or the like, and which specifies a single layer structure in which a color layer M is formed by ejecting the color inks 51C, 51M, 51Y and 51K directly onto the first face 9 of the printed textile material T.

Meanwhile, a printing specification shown in FIG. 5B is a specification which is mostly employed in the case where the printed textile material T has a color background or the like, and which specifies a two layer structure in which, first, a background layer U is formed by ejecting the background ink 51W onto the first face 9 of the printed textile material T, and further, the color layer M is formed by ejecting the color inks 51C, 51M, 51Y and 51K onto the surface of the background layer U.

In addition, a method for grasping the remaining amount of any of the inks performed by the corresponding liquid remaining amount grasping unit 5 is not limited to a specific one. For example, the remaining amount of any of the inks may be obtained by performing an arithmetic operation based on the counted number of ejections from the corresponding ink ejection head, or may be grasped by causing a sensor provided for the corresponding ink cartridge therefor to perform direct detection.

Next, an ink jet textile printing method according to a practical example of the invention, performed by using the ink jet textile printing apparatus 1A configured in such a way as described above according to this practical example, will be described.

An ink jet textile printing method according to this practical example includes printing specification setting processing for, regarding the two sheets of the printed textile materials T1 and T2 which are set on the corresponding set trays 4A and 4B moving relative to the liquid ejection heads 13C and 13W capable of ejecting the first liquid (corresponding to the color inks 51C, 51M, 51Y and 51K) and the second liquid (corresponding to the white ink 51W), respectively, and which substantially align in a direction along the movement of the set trays 4A and 4B, setting two kinds of printing specifications of a first printing specification using the first liquid (corresponding to the color inks 51C, 51M, 51Y and 51K) and a second printing specification using the second liquid (corresponding to the white ink 51W); liquid remaining amount grasping processing for grasping the remaining amounts of the respective two kinds of liquids (corresponding to the color inks 51C, 51M, 51Y and 51K, and the white ink 51W, respectively); and printing execution processing for, in advance of starting execution of printings based on the respective two kinds of printing specifications, specifying any print-executable printing specification from the printing specifications on the basis of the remaining amounts of the respective liquids (corresponding to the color inks 51C, 51M, 51Y and 51K, and the white ink 51W) having been grasped in the liquid remaining amount grasping processing, and the contents of the respective printing specifications, and then, starting execution of any printing based on the any print-executable printing specification having been specified.

Further, in this practical example, as described above, the printing specifications having been set in the printing specification processing includes two kinds of printing specifications, one being the first printing specification shown in FIG. 5A, in which the color inks 51C, 51M, 51Y and 51K for forming images are directly ejected onto the surface, i.e., the first face 9 of the printed textile material T, the other one being the second printing specification shown in FIG. 5B, in which the white ink 51W for forming a background is ejected onto the surface, i.e., the first face 9 of the printed textile material T, and then the color inks 51C, 51M, 51Y and 51K are ejected.

Further, in the case where liquid remaining amount information 39 having been grasped in the liquid remaining grasping processing is information notifying the insufficient remaining amount of the white ink 51W, processing is configured such that, in the printing execution processing, any printing based on the second printing specification is suspended, and only any printing based on the first printing specification is executed.

Next, regarding operations from the start until the end of printings onto the first printed textile material set on the first set tray 4A and the second printed textile material set on the second set tray 4B, an example of the flow of processing performed by the control unit 7 will be described on the basis of a flowchart shown in FIG. 6.

The first printed textile material T1 and the second printed textile material T2 are set on the first set tray 4A and the second set tray 4B, respectively, and then, an instruction for executing printings thereonto is issued.

Here, assuming that, in accordance with the instruction for executing printings, the printing specification shown in FIG. 5A and the printing specification shown in FIG. 5B are set with respect to the first printed textile material T1 and the second printed textile material T2, respectively, the following description will be made.

First, the first set tray 4A is moved to the first printing start position K1. Further, in advance of starting the execution of printings, control shown in the flowchart of FIG. 6 is performed.

In step S1, first, it is determined whether the remaining amounts of the respective color textile-printing inks (the color inks 51C, 51M, 51Y and 51K) are sufficient, or not. This determination is made on the basis of the remaining amounts of the respective color inks 51C, 51M, 51Y and 51K, which have been grasped by the liquid remaining amount grasping units 5 provided for the color ink cartridges 41 corresponding to the color inks, respectively, and the contents of the respective printing specifications described above. The liquid remaining amount grasping units 5 are each configured to obtain the remaining amount of a corresponding ink by counting the number of ejections of the ink and performing an arithmetic operation based on the counted number.

If it has been determined that the remaining amounts of all the color inks 51C, 51M, 51Y and 51K are sufficient, the process flow proceeds to step S2, where it is determined whether the remaining amount of the white color 51W is sufficient, or not. This determination is also made on the basis of the remaining amount of the white ink 51W having been grasped by the liquid remaining amount grasping unit 5 provided for the cartridge 41 corresponding to the white ink 51W, and the contents of the respective printing specifications described above.

If it has been determined in step S2 that the remaining amount of the white ink 51W is sufficient, the process flow proceeds to step S3, where the printings based on the respective two printing specifications are executed.

In contrast, if it has been determined in step S2 that the remaining amount of the white ink 51W is insufficient, the process flow proceeds to step S4, where the printing based on the printing specification using the white ink is not executed, and only the printing based on the printing specification using the color inks 51C, 51M, 51Y and 51K is executed. In this way, since the printing using the white ink is not executed, but the printing using the color inks is executed, this execution of the printing using the color inks leads to an improvement of the operational efficiency of the existing textile printing. Subsequently, the process flow proceeds to step S5, where the insufficiency of the remaining amount of the white ink is notified to users by means of a lamp indication, a character-based indication on a display, or the like, to prompt the replacement of the corresponding ink cartridge 41.

If it has been determined in step S1 that the remaining amount of at least one of the color textual-printing inks is insufficient, the process flow proceeds to step S6. In step S6, irrespective of the remaining amount situation regarding the white ink 51W, control for not executing any printing is performed. This is because of the following thought.

In the case where a background is formed by using the white ink 51W, the background can be formed by ejecting only the white ink 51W; however, in most of cases, the small amount of any of the color inks is ejected so as to be mixed with the white ink. This processing is based on a thought that, even in the case of a white-color background layer, it is generally performed to form the white color as a bluish white color, a yellowish white color, a reddish white color or the like.

Subsequently, the process flow proceeds to step S7, where the insufficiency of the remaining amount of the at least one of the color inks is notified to users by means of a lamp indication, a character-based indication on a display, or the like, to prompt the replacement of the corresponding ink cartridge 41.

Next, regarding operations from the start until the end of printings onto the first printed textile material set on the first set tray 4A and the second printed textile material set on the second set tray 4B, another example of the flow of processing performed by the control unit 7 will be described on the basis of a flowchart shown in FIG. 7.

Figure 6:
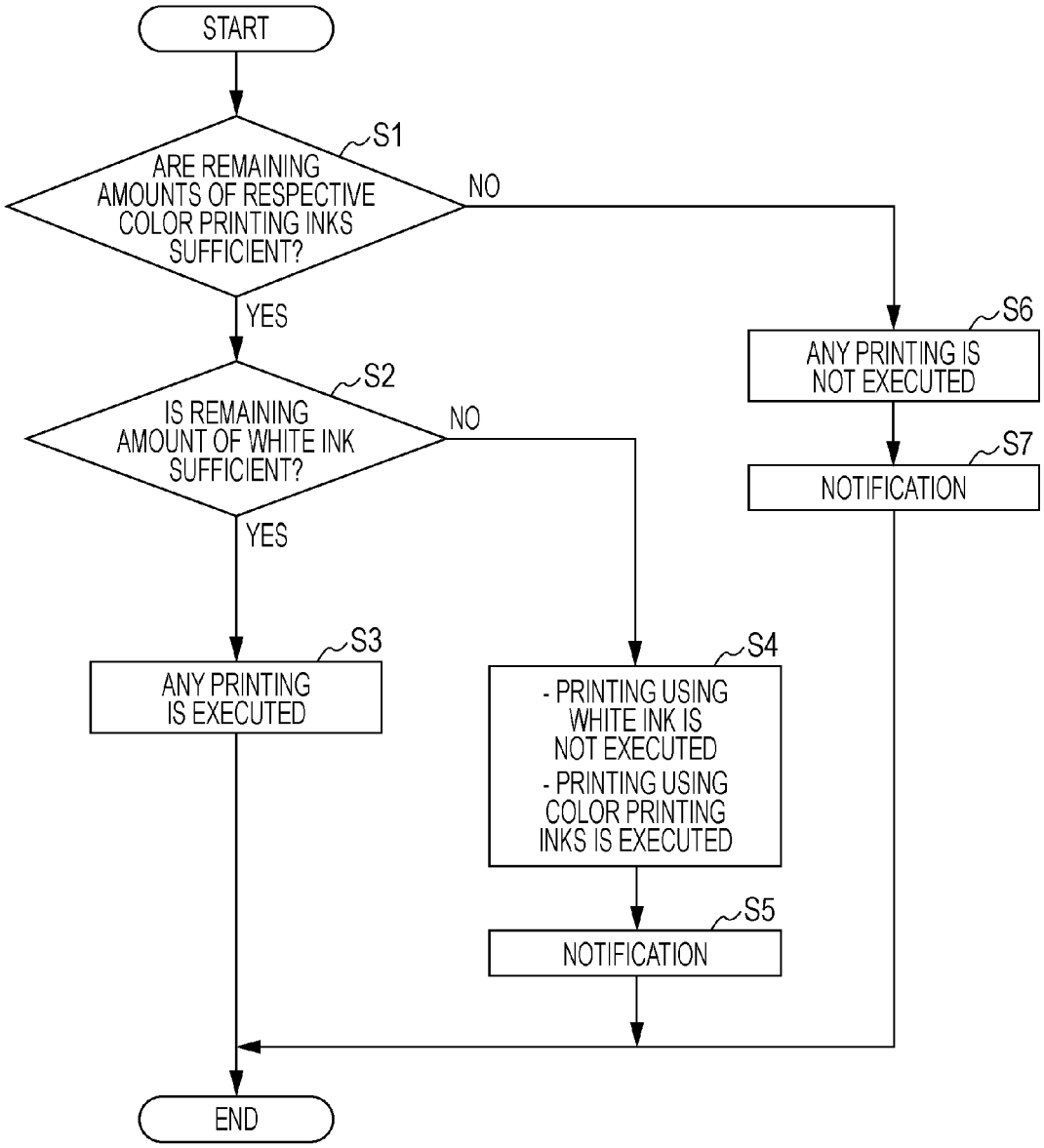
FIG. 6 is a flowchart illustrating an example of the flow of operations when printings are performed onto corresponding printed textile materials by using an ink jet textile printing apparatus according to a first practical example of the invention.
Figure 7:
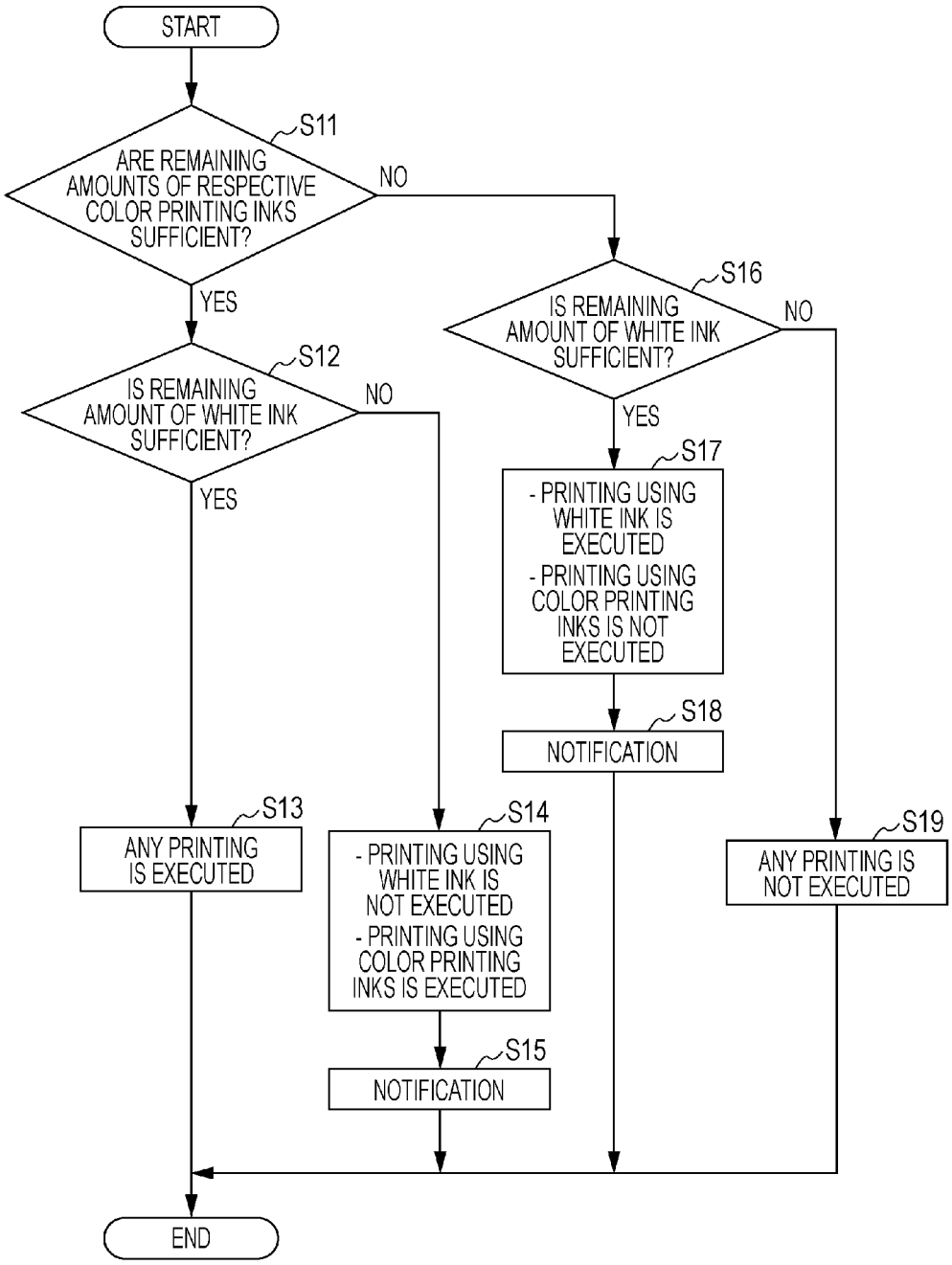
FIG. 7 is a flowchart illustrating another example of the flow of operations when printings are performed onto corresponding printed textile materials by using an ink jet textile printing apparatus according to a first practical example of the invention.

The processes from step S11 to step S15 shown in FIG. 7 are the same as those from step S1 to step S5 shown in FIG. 6, and thus, the descriptions thereof are omitted here.

In step S11, if it has been determined that the remaining amount of at least one of the textile printing color inks is insufficient, the process flow proceeds to step S16. In step S16, it is determined whether the remaining amount of the white ink 51W is sufficient, or not. If it has been determined in step S16 that the remaining amount of the white ink 51W is sufficient, the process flow proceeds to step S17, where the printing using the color textile-printing inks is not executed, but only the printing using the white ink 51W is executed. This control method is employed in the case where a white color background is formed by using only the white ink.

In this way, since the printing using the color inks is not executed, but the printing using the white ink is executed, this execution of the printing using the white ink leads to an improvement of the operational efficiency of the existing textile printing. Subsequently, the process flow proceeds to step S18, where the insufficiency of the remaining amount of the at least one of the color inks is notified to users by means of a lamp indication, a character-based indication on a display, or the like, to prompt the replacement of the corresponding ink cartridge 41.

If it has been determined in step S16 that the remaining amount of the white ink 51W is insufficient, the process flow proceeds to step S19, where control for not executing any printing is performed.

Next, the effectiveness of the printing operations performed by the ink jet textile printing apparatus 1A according to this practical example will be described on the basis of FIG. 8.

A case denoted by (A) in FIG. 8 indicates a case where the printing onto the first printed textile material T1 and the printing onto the second printed textile material T2 are performed on the basis of the second printing specification using the white ink 51W, and the first printing specification not using the background ink 51W, respectively. A case denoted by (B) in FIG. 8 indicates a case where the printing onto the first printed textile material T1 and the printing onto the second printed textile material T2 are performed on the basis of the first printing specification and the second printing specification, respectively.

Further, a case denoted by (C) in FIG. 8 indicates a case where each of the printings onto the first printed textile material T1 and the second printed textile material T2 is performed on the basis of the second printing specification, and a case denoted by (D) in FIG. 8 indicates a case where each of the printings onto the first printed textile material T1 and the second printed textile material T2 is performed on the basis of the first printing specification.

Further, regarding the effectiveness yielded when the insufficiency of the remaining amount of the white ink 51W has occurred, each of the cases denoted by (A), (B) and (D) in FIG. 8 is "effective", and this result indicates that an improvement of the operational efficiency of the existing textile printing has been achieved.

According to the ink jet textile printing apparatus 1A described above, when performing printings onto a plurality of printed textile materials T based on respective different printing specifications, even if the insufficiency of a remaining amount occurs with respect to some of liquids, any print job based on any printing specification not including any data regarding the some of the liquids, for each of which the insufficiency of the remaining amount has occurred, can be completed, thereby enabling execution of a printing corresponding to the any print job.

Figure 9A:
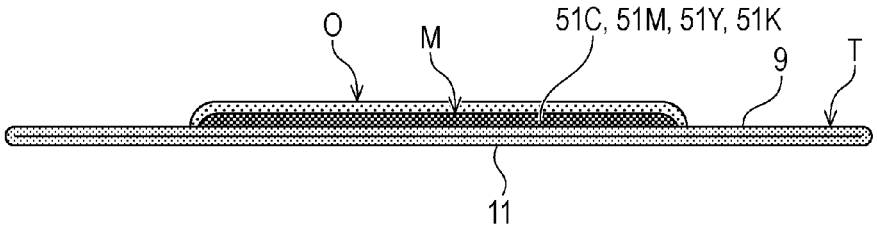
FIGS. 9A and 9B are vertical sectional front views illustrating respective mutually different printing specifications applicable to an ink jet textile printing apparatus according to a second practical example of the invention.
Figure 9B:
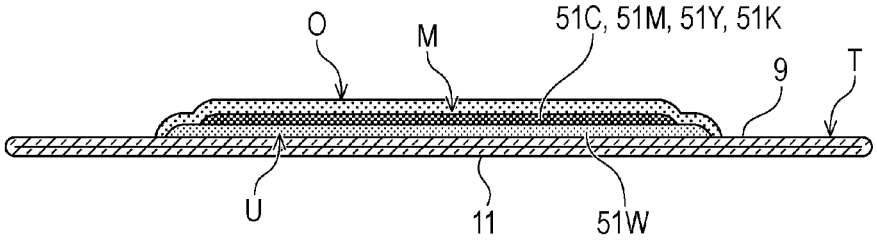
Figure 10:
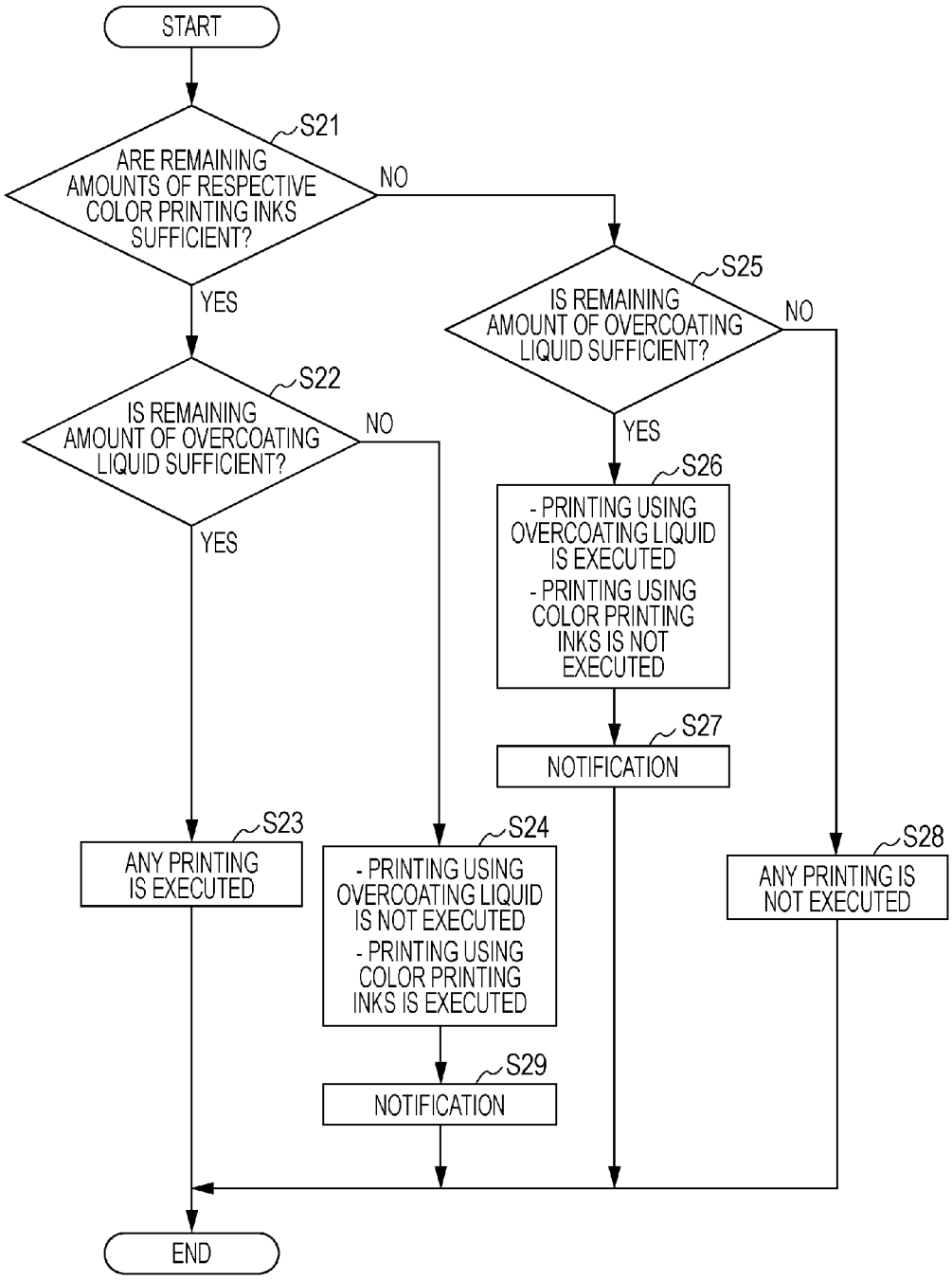
FIG. 10 is a flowchart illustrating an example of the flow of operations when printings are performed onto corresponding printed textile materials by using an ink jet textile printing apparatus according to a second practical example of the invention.

Second Practical Example (Refer to FIGS. 9 and 10)

A textile printing apparatus according to this second practical example is a textile printing apparatus resulting from adding a configuration which enables ejection of an overcoating liquid to the ink jet printing apparatus according to the first practical example. That is, a textile printing apparatus according to this second practical example is provided with three liquid ejection heads including a third liquid ejection head (not illustrated) for ejecting a third liquid, i.e., an overcoating liquid, in addition to the first liquid ejection head 13C and the second liquid ejection head 13W having been described in the first practical example.

Moreover, the textile printing apparatus according to this second practical example is configured to, in the case where an instruction for executing printings based on three kinds of printing specifications including a third printing specification using the overcoating liquid as the third liquid is given, determine whether it is possible or not to execute any printing using the overcoating liquid, on the basis of the remaining account of the overcoating liquid having been grasped by the above-described liquid remaining amount grasping unit.

In this practical example, two kinds of printing specifications shown in FIGS. 9A and 9B can be applied, and of these, a printing specification shown in FIG. 9A is a specification which is mostly employed in the case where the printed textile material T has a white background or the like, and which is used for a two layer structure in which an overcoating layer O is formed by ejecting an overcoating liquid onto the surface of the color layer M resulting from ejecting the color inks 51C, 51M, 51Y and 51K directly onto the first face 9 of the printed textile material T.

Meanwhile, a printing specification shown in FIG. 9B is a specification which is mostly employed in the case where the printed textile material T has a color background or the like, and which is used for a three layer structure in which the background layer U is formed as a first layer by ejecting the background ink 51W onto the first face 9 of the printed textile material T, the color layer M is formed as a second layer by ejecting the color inks 51C, 51M, 51Y and 51K onto the surface of the background layer U, and the overcoating layer O is formed as a third layer by ejecting an overcoating liquid onto the surface of the color layer M.

Next, regarding operations from the start until the end of printings onto the first printed textile material set on the first set tray 4A and the second printed textile material set on the second set tray 4B, the flow of processing performed by the control unit 7 will be described on the basis of a flowchart shown in FIG. 10.

The first printed textile material T1 and the second printed textile material T2 are set on the first set tray 4A and the second set tray 4B, respectively, and then, an instruction for executing printings thereonto is issued.

Here, assuming that, in accordance with the instruction for executing printings, a printing phase for forming the overcoating layer O in the printing specification shown in FIG. 9A and a printing phase for forming the color layer M in the printing specification shown in FIG. 9B have been set with respect to the first printed textile material T1 and the second printed textile material T2, respectively, the following description will be made.

First, the first set tray 4A is moved to the first printing start position K1. Further, in advance of starting the execution of printings, control shown in the flowchart of FIG. 10 is performed.

In step S21, first, it is determined whether the remaining amounts of the respective color textile-printing inks (i.e., the color inks 51C, 51M, 51Y and 51K) are sufficient, or not. This determination is made on the basis of the remaining amounts of the respective color inks 51C, 51M, 51Y and 51K, which have been grasped by the liquid remaining amount grasping units 5 provided for the color ink cartridges 41 corresponding to the color inks, respectively, and the contents of the printing specifications described above.

If it has been determined in step S21 that the remaining amounts of all the color inks 51C, 51M, 51Y and 51K are sufficient, the process flow proceeds to step S22, where it is determined whether the remaining amount of the overcoating liquid is sufficient, or not. This determination is also made on the basis of the remaining amount of the overcoating liquid having been grasped by the liquid remaining amount grasping unit 5 provided for the cartridge 41 corresponding to the overcoating liquid, and the contents of the printing specifications described above.

If it has been determined in step S22 that the remaining amount of the overcoating liquid is sufficient, the process flow proceeds to step S23, where printings based on the respective two printing specifications (corresponding to printings regarding the overcoating layer O shown in FIG. 9A and the color layer M shown in FIG. 9B) are executed.

In contrast, if it has been determined in step S22 that the remaining amount of the overcoating liquid is insufficient, the process flow proceeds to step S24, where the printing using the overcoating liquid is not executed, and only the printing using the color inks 51C, 51M, 51Y and 51K is executed. In this way, since the printing using the overcoating liquid is not executed, but the printing using the color inks is executed, this execution of the printing using the color inks leads to an improvement of the operational efficiency of the existing textile printing. Subsequently, the process flow proceeds to step S29, where the insufficiency of the remaining amount of the overcoating liquid is notified to users by means of a lamp indication, a character-based indication on a display, or the like, to prompt the replacement of the corresponding ink cartridge 41.

If it has been determined in step S21 that the remaining amount of at least one of the color textile-printing inks is insufficient, the process flow proceeds to step S25. In step S25, it is determined whether the remaining amount of the overcoating liquid is sufficient, or not. If it has been determined in step S25 that the remaining amount of the overcoating liquid is sufficient, the process flow proceeds to step S26, where the printing using the color textile-printing inks is not executed, and only the printing using the overcoating liquid is executed.

In this way, since the printing using the color inks is not executed, but the printing using the overcoating liquid is executed, this execution of the printing using the overcoating liquid leads to an improvement of the operational efficiency of the existing textile printing. Subsequently, the process flow proceeds to step S27, where the insufficiency of the remaining amount of the at least one of the color inks is notified to users by means of a lamp indication, a character-based indication on a display, or the like, to prompt the replacement of the corresponding ink cartridge 41.

If it has been determined in step S25 that the remaining amount of the overcoating liquid is insufficient, the process flow proceeds to step S19, where control for not executing any printing is performed.

In the second practical example described above, the case where two printed textile materials are set on the set tray 3 has been described, but, in the case where three or more printed textile materials are set thereon, processing can be also performed in a way similar to that of the second practical example. Examples of such a case include a case where, in accordance with an instruction for executing printings, a printing phase for forming the overcoating layer O in the printing specification shown in FIG. 9A, a printing phase for forming the color layer M in the printing specification shown in FIG. 9B and a printing phase for forming the white color ink layer U in the printing specification shown in FIG. 9B have been set with respect to the first printed textile material T1, the second printed textile material T2 and a third printed textile material, respectively. The detailed description of this case is omitted here.

Figure 11:
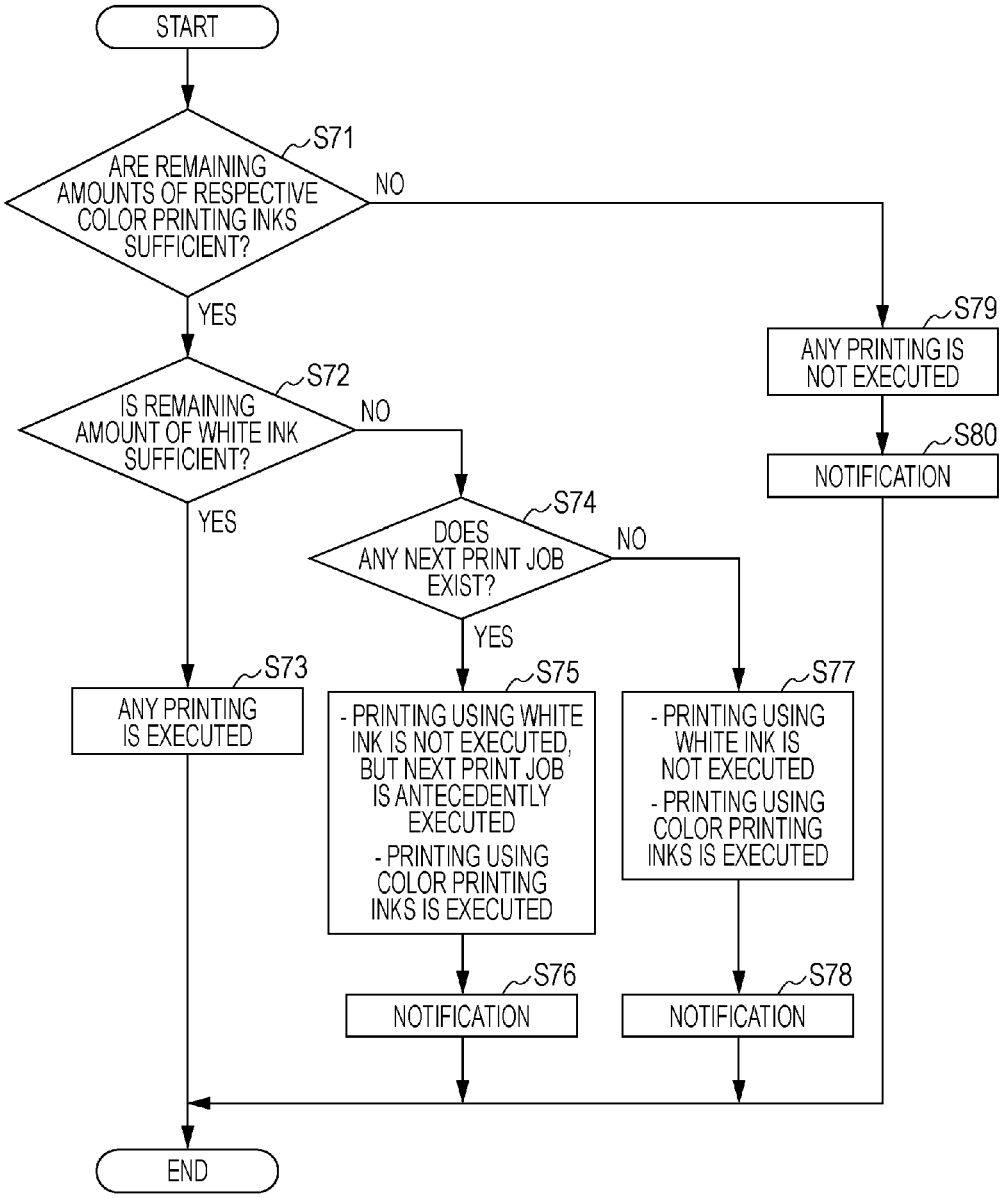
FIG. 11 is a flowchart illustrating an example of the flow of operations when printings are performed onto corresponding printed textile materials by using an ink jet textile printing apparatus according to a third practical example of the invention.

Third Practical Example (Refer to FIG. 11)

A textile printing apparatus according to a third practical example of the invention is a textile printing apparatus in which control performed by the control unit 7 is different from that of the first practical example in some points. That is, the control unit 7 is configured to, in the case where, in a certain printing specification corresponding to a print job to be executed, the remaining amount of a liquid used therein (for example, corresponding to the white ink 51W) is insufficient, if there is prepared a next print job based on a printing specification which targets a printed textile material whose kind is the same as that of a printed textile material targeted by the certain printing specification, and which uses a liquid (for example, corresponding to the color inks 51C, 51M, 51Y and 51K) whose remaining amount is not insufficient, execute the next print job prior to the print job based on the certain printing specification.

This processing will be described on the basis of FIG. 11.

Here, assuming that, in accordance with an instruction for execution printings, the printing specification shown in FIG. 5A and the printing specification shown in FIG. 5B have been set with respect to the first printed textile material T1 and the second printed textile material T2, respectively, the following description will be made.

First, the first set tray 4A is moved to the first printing start position K1. Further, in advance of start the execution of printings, control shown in a flowchart of FIG. 11 is performed.

In step S71, first, it is determined whether the remaining amounts of the respective color textile-printing inks (i.e., the color inks 51C, 51M, 51Y and 51K) are sufficient, or not.

If it has been determined that the remaining amounts of all the color inks 51C, 51M, 51Y and 51K are sufficient, the process flow proceeds to step S72, where it is determined whether the remaining amount of the white color 51W is sufficient, or not. This determination is also made on the basis of the remaining amount of the white ink 51W having been grasped by the liquid remaining amount grasping unit 5 provided for the cartridge 41 corresponding to the white ink 51W, and the contents of the printing specifications described above.

If it has been determined in step S72 that the remaining amount of the white ink 51W is sufficient, the process flow proceeds to step S73, where the printings based on the respective two printing specifications are executed.

In contrast, if it has been determined in step S72 that the remaining amount of the white ink 51W is insufficient, the process flow proceeds to step S74, where it is determined whether a "next print job" exists, or not. If the next print job exists, the process flow proceeds to step S75, where the printing using the white ink is not executed, but, instead, the next print job is antecedently executed. Subsequently, the printing using the color inks is executed. Further, the process flow proceeds to step S76, where the insufficiency of the remaining amount of the white ink is notified to users by means of a lamp indication, a character-based indication on a display, or the like, to prompt the replacement of the corresponding ink cartridge 41.

If it has been determined in step S74 that any next job does not exist, the process flow proceeds to step S77. The contents of this step S77, and step S78 following it, are the same as those of step S4, and step S5 following it, and thus, the descriptions thereof are omitted here. Moreover, the contents of step S79 and step S80, which are carried out after it has been determined in Step S71 that the remaining amount of at least one of the color inks is insufficient, are the same as those of step S6, and step S7 following it, shown in FIG. 6, and thus, the descriptions thereof are omitted here.

According to this practical example, it is determined whether any print-executable printing specification exists, or not, on the basis of not only a printing specification corresponding to a relevant print job, but also a printing specification corresponding a print job following the relevant print job. Therefore, it is made possible to find out print-executable printing specifications to a larger extent, and thus, this leads to a further improvement of the operational efficiency of the existing textile printing.

Other Practical Examples

It is a basis that the ink jet textile printing apparatus 1 and the ink jet printing method according to the invention have configurations described above, but, naturally, partial changes, omissions and the like regarding the configurations thereof can be made within the scope not departing the gist of the invention.

In the case where at least one of the color inks 51C, 51M, 51Y and 51K has an insufficient remaining amount, if there exists any printing specification using any of the color inks 51C, 51M, 51Y and 51K which is other than the at least one of the color inks 51C, 51M, 51Y and 51K which has an insufficient remaining amount, it is also possible to cause any printing based on the any printing specification to be antecedently executed.

Further, it is also possible to use any of the color inks 51C, 51M, 51Y and 51K as a background ink instead of the background ink 51W, and in this case, preferably, the color density of the color ink is reduced, or any spot color having a thin color, or the like, is employed.

Moreover, the number of the printed textile materials T is not limited to "two" shown in the described-above practical examples 1 and 2, and further, can be made three or more. Furthermore, a line head type liquid ejection head, which does not have the carriage 21, can be also employed as the liquid ejection head 13.

The entire disclosure of Japanese Patent Application No. 2011-209193, filed Sep. 26, 2011 is expressly incorporated by reference herein.

What is claimed is:

1. A textile printing apparatus comprising:

a liquid ejection head which ejects two or more kinds of liquids including at least a first liquid and a second liquid;

a set tray which moves relative to the liquid ejection head, and which enables setting of a plurality of printed textile materials thereon such that the printed textile materials substantially align in a direction along the movement of the set tray;

a liquid remaining amount grasping unit which grasps remaining amounts of the respective at least two kinds of liquids; and a control unit which performs control of operations of printings onto the plurality of printed textile materials, wherein, in the case where the control unit is given an instruction for executing printings onto a plurality of printed textile materials, which are set on the set tray so as to substantially align in the direction along the movement of the set tray, on the basis of two or more kinds of printing specifications including at least a first printing specification using the first liquid and a second printing specification using the second liquid, the control unit has a control mode for, in advance of starting the execution of printings, specifying any print-executable printing specification from among the printing specifications on the basis of the remaining amounts of the respective liquids and the contents of the respective printing specifications, and then, starting execution of any printing based on the any print-executable printing specification having been specified.

2. The textile printing apparatus according to claim 1, wherein the first liquid corresponds to a color textile-printing ink which enables formation of a color image, the second liquid corresponds to a white ink, and if a grasping result obtained by the liquid remaining amount grasping unit indicates a state where the remaining amount of the white color is insufficient, and further, the remaining amount of the color textile-printing ink is sufficient, the control unit does not execute any printing based on any printing specification using the white ink, and execute any printing based on any printing specification using only the color textile-printing ink.

3. The textile printing apparatus according to claim 2, wherein, if a grasping result obtained by the liquid remaining amount grasping unit indicates a state where the remaining amount of the white color is sufficient, and further, the remaining amount of the at least one color textile-printing ink is insufficient, the control unit does not perform any printing based on any printing specification.

4. The textile printing apparatus according to claim 1, wherein, in the case where the control unit is given an instruction for executing printings based on three kinds of printing specifications resulting from adding a third printing specification in which an overcoating liquid is further used as a third liquid, the control unit is configured to determine whether it is possible or not to execute any printing which uses the overcoating liquid on the basis of the remaining amount of the overcoating liquid, which has been grasped by the liquid remaining amount grasping unit.

5. The textile printing apparatus according to claim 1, wherein, in the case where, in a certain printing specification corresponding to a print job to be executed, the remaining amount of a liquid used therein is insufficient, if there is prepared a next print job based on a printing specification which targets a printed textile material whose kind is the same as that of a printed textile material targeted by the certain printing specification, and which uses a liquid whose remaining amount is not insufficient, the control unit executes the next print job prior to the print job based on the certain printing specification.

6. A textile printing method comprising:

printing specification setting processing for, regarding a plurality of printed textile materials which are set on a set tray moving relative to a liquid ejection head capable of ejecting two or more kinds of liquids including at least a first liquid and a second liquid, and which substantially align in a direction along the movement of the set tray, setting two or more kinds of printing specifications including at least a first printing specification using the first liquid and a second printing specification using the second liquid;

liquid remaining amount grasping processing for grasping the remaining amounts of the respective two or more kinds of liquids; and printing execution processing for, in advance of starting execution of printings based on the respective printing specifications, specifying any print-executable printing specification from among the printing specifications on the basis of the remaining amounts of the respective liquids and the contents of the respective printing specifications, and then, starting execution of any printing based on the any print-executable printing specification having been specified.

* * * * *